United States Patent [19]

Wait

[11] Patent Number: 4,960,239

[45] Date of Patent: Oct. 2, 1990

[54] GOLF TOOL AND CARRIER FOR GOLF ITEMS

[76] Inventor: David S. Wait, 226 E. John St., Forrest, Ill. 61741

[21] Appl. No.: 485,220

[22] Filed: Feb. 26, 1990

[51] Int. Cl.[5] ..... A63B 57/00

[52] U.S. Cl. ..... 273/32 B; 273/32 A; 273/32 D; 224/918

[58] Field of Search ..... 273/32 A, 32 B, 32 R, 273/162 D, 162 F, 162 R; 224/918

[56] References Cited

U.S. PATENT DOCUMENTS

| | | | |
|---|---|---|---|
| 3,620,426 | 11/1971 | Hatch | 273/32 A |
| 3,753,519 | 8/1973 | Gammon | 224/918 |
| 3,866,749 | 2/1975 | Stainer | 273/32 A |
| 4,151,937 | 5/1979 | Jarosh et al. | 224/252 |
| 4,475,676 | 10/1984 | Smith | 224/247 |

*Primary Examiner*—George J. Marlo

[57] ABSTRACT

A conveniently carried golf device combines a turf repair tool with a carrier for a pair of golf tees and a ball marker. The device includes a one-piece body formed with a pair of tee-receiving cavities in an end face of the body. The body is formed at another end into a turf repair tool including a pair of prongs. A belt clip is preferably integrally formed with the body at a bottom face of the body so that the device may be conveniently clipped to a pocket or belt of the golfer. In one embodiment, a pair of resilient clips are attached to the top face of the body. A slot is formed in the body to open at the top face and the end face. The slot is adapted to receive the stem of a ball marker therein. The resilient clips can be urged away from the top face to accept the disk of the ball marker and to retain the marker adjacent the top face. The ball marker can be readily removed by sliding the marker from the slot and past the resilient clips.

10 Claims, 3 Drawing Sheets

GOLF TOOL AND CARRIER FOR GOLF ITEMS

BACKGROUND OF THE INVENTION

This invention relates to a device or aid for the game of golf, and more particularly to a device which combines a golf tool with a carrier for small items used by a golfer.

In order to play the game of golf, a golfer needs to keep certain items at hand. In particular, a golf tee is a virtual necessity, and many golfers carry a ball marker or ball spot. Golfing etiquette dictates that golfers also carry a turf or greens repair tool to repair small divots left in the green due to the impact of a well placed iron shot.

Many golfers carry a supply of tees, ball markers and a turf repair tool in their pockets. Some golfers use a ball marker that is snapped on to a typical golf glove. Because these items are small, it is often difficult for the golfer to locate a particular golf item, especially if the items are kept in a pocket.

Golf is a game that is loaded with annoyances - some provided by the course itself, and others are a result of the many problems that can plague a golfer (such as a troublesome slice or hook). It is therefore important that the golfer eliminate as many annoyances as possible that might disturb his or her concentration on the course. Having to fish through pockets in order to find the appropriate golf item is one annoyance that can be eliminated. Accordingly, one of the objects of the present invention is to provide a combination golf tool and carrier for golf items which is readily accessible to the golfers. Another object of the present invention is to provide such a device which is inexpensive and easy to manufacture.

SUMMARY OF THE INVENTION

These and other objects of the present invention are attained in the provision of a golf device comprising a one-piece body having a top face, a bottom face and an end face. The device includes a turf repair tool including a pair of prongs extending from the body opposite the end face. The body has a number of elongated cavities extending from the end face into the body, each of the number of cavities being sized to snugly receive a golf tee therein. A slot is defined in the body which opens at the top face and at the end face for slidably receiving the stem of a ball marker therein. Means are provided for retaining the disk of the ball marker at the top face when the stem is within the slot, such as a pair of resilient retaining clips which are resiliently displaceable to permit insertion and removal of the ball marker disk from the golf device. A belt clip is attached to the one-piece body at the bottom face so that the device can be clipped to a belt of pocket.

Other objects and benefits of the present invention will become apparent from the following written description and accompanying figures.

DESCRIPTION OF THE PREFERRED EMBODIMENTS

Figure 1:
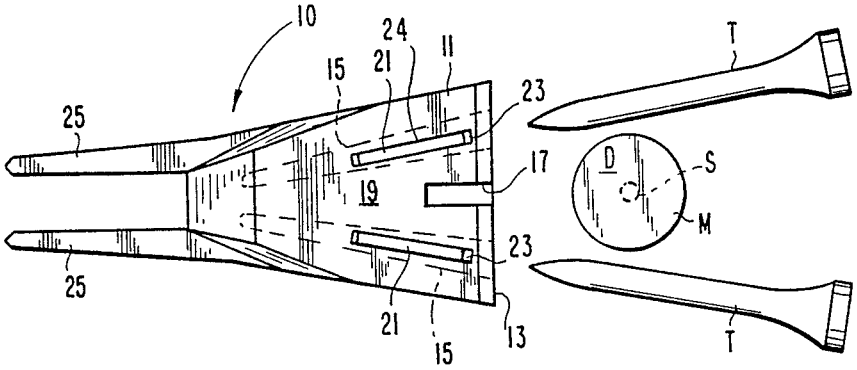
FIG. 1 is a top elevational view of a device embodying the features of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being comtemplated as would normally occur to one skilled in the art to which the invention relates.

A golf device 10 of one embodiment of the present invention is shown in FIG. 1. The device 10 includes a generally solid body 11 having an end face 13. A pair of elongated cavities 15 project inwardly into the body 11 from the end face 13. The cavities 15 are shaped to conform to the outer dimensions of a golf tee T. In the preferred embodiment of the invention, two such cavities 15 are provided to carry a pair of pair of tees T. However, it is contemplated that the body 11 can be enlarged to accommodate more cavities to carry a greater number of golf tees. The cavities 15 are only slightly larger than the golf tees in order to provide firm support for the tees and to prevent them from falling out of the cavities. The cavities may be lined with a foam or similar material that can form a friction fit for the golf tees T inserted therein.

The body 11 further includes a slot 17 that is cut from the top face 19 of the body toward the bottom face 28. The slot opens at and projects inward from the end face 13. The slot 17 is intended to receive the stem S of a standard ball marker M, which is of conventional shape and size. The marker M includes a circular disk D with the stems projecting perpendicularly therefrom. The slot 17 has a width that is slightly larger than the outer diameter of the stem S of the ball marker M. The depth of the slot 17 need only be enough to accommodate the length of the stem S of the ball marker M. However, in the present embodiment, the slot 17 is shown as extending entirely from the top surface 19 to the bottom surface 28 of the body 11 (see FIGS. 2 and 4).

The golf device 10 further includes means for retaining the marker which, in the present embodiment, comprises a pair of retaining clips 21 which are situated on the top face 19 of the body 11. Each clip includes an arm 24 which is connected at its base 22 to the body at the top face 19. The tip 23 of each of the arms 24 is preferably wedge-shaped and is not integral with or connected to the top face 19. The arm 24 is resiliently flexible so that the tip 23 can be resiliently displaced from the top face 19 of the body 11 to permit passage of the marker disk D.

In use, the ball marker M is inserted into the device 10 with the stem S moving into the slot 17. The disk D of the marker M contacts the tips 23 of the retaining clips 21 and resiliently displaces the tips away from the top face 19 of the body 11 until the disk D passes fully under the arms 24. Once the disk D of the marker has cleared the tips 23, the marker M is firmly retained by the resilient retaining clips 21 between the arms 24 and top face 19. The tips 23 prevent the marker M from being readily removed from the slot 17 of the golf device 10. Thus, the distance between the tips 23 of the retaining clips 21 must be slightly less than the outer diameter of the disk D of the ball marker M. In the present embodiment, the distance between the base 22 of the retaining clips 21 is less than the gap between the tips 23 so that the arms 24 angle toward each other. In this manner, the arms must overlap at least some part of the disk D to hold the marker M securely on the golf device 10 until the golfer desires to use the marker. Alternatively, a single clip may be used or the arms of the clip may be sufficiently close to the top face 19 to form a friction fit to hold the marker disk in place.

Figure 2:
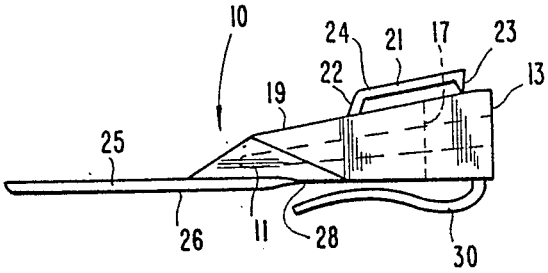
FIG. 2 is a side elevational view of the device shown in FIG. 1.
Figure 3:
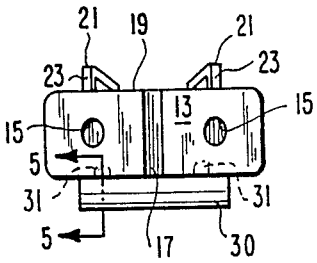
FIG. 3 is an opposite end elevational view of the device shown in FIG. 1.

In another important aspect of the invention, the body 11 of the golf device 10 is formed at one end into a turf repair tool. The body 11 includes a pair of prongs 25 as shown in FIGS. 1 and 2. The underside or bottom surface of each prong 25 includes a beveled or sloped surface 26 which provides leverage for use as a turf repair tool. Other geometries for the prongs 25 and bevel 26 are contemplated that can function as a greens or turf repair tool.

As shown more clearly in FIG. 2 the golf device 10 includes a belt clip 30 attached thereto. The belt clip 30 allows the golf device 10 to be carried on the belt or in a shirt pocket of the golfer, or at some other convenient location such as on the golf bag. In the preferred embodiment, the belt clip is formed integrally with the body 11. It is important that the belt clip 30 be formed of a sufficiently resilient material to adequately grip the belt or shirt pocket and support the device 10.

Figure 4:
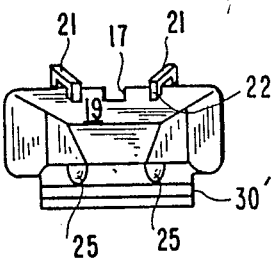
FIG. 4 is an end elevational view of the device shown in FIG. 1.
Figure 5:
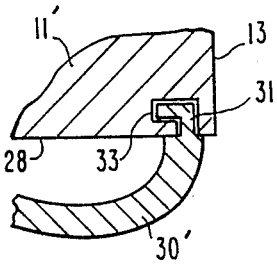
FIG. 5 is a sectional view taken along line 5—5 in FIG. 4.

In an alternative embodiment shown in FIGS. 4 and 5, a belt clip 30' is attached to a body 11' which is identical to the body 11 with the addition of a pair of channels 33 formed in the bottom face 28 of the body. This separate clip 30' is preferably formed of the same resilient material as the belt clip 30 of the prior embodiment, although it may be composed of a flexible metal or other similar resilient material. In this embodiment, the belt clip 30' is held in place by a pair of fingers 31 which are spaced apart across the width of the body 11. As shown more clearly in the detail of FIG. 5, the finger 31 fits into a channel 33 molded into the body 11'. Both the fingers 31 and the channels 33 are L-shaped to provide a permanent lock or attachment for the belt clip. Since the belt clip 30' is formed of a resilient material, the fingers 31 can be readily snapped into the channels 33 in a conventional fashion by slightly deforming the fingers on insertion into the channels. While two fingers 31 and channels 33 are described, a greater number of each may be provided.

The golf device 10 of the present embodiment is most preferably formed of a resilient yet durable plastic that can be readily formed in a standard molding or casting process. Such a plastic may be polypropylene, although other similar materials are contemplated (for instance, a resin or rubber compound). It is also preferable that the device be composed of lightweight material for the convenience of the golfer. The retaining clips 21 and the belt clip 30 must be sufficiently durable to withstand frequent flexing. In the present embodiment the body 11, including the cavities 15, slot 17, clips 21, prongs 25 and channels 33 are formed in a single piece. The belt clip is separately molded and then snapped into the channels 33 of the body 11.

The body 11 of the present embodiment is optimally formed as small as possible yet capable of carrying a pair of golf tees and a ball marker, and of functioning as a turf repair tool. For this reason, the tee receiving cavities 15 are angled downwardly and inwardly toward the centerline of the body 11. The cavities must be separated enough to clear the slot 17. On the other hand, it is necessary that the body 11 be large enough to provide an adequate gripping surface for the golfer when the turf repair feature of the device is being used. In keeping with these requirements, the golf device of one specific embodiment of the invention is approximately $1\frac{1}{4}$ inches wide across the end face 13, with a total length of $3\frac{1}{4}$ inches from the end face to the tip of the prongs 25. The prongs 25 themselves are approximately $\frac{1}{8}$ inch wide and have a length of about 1/14 inches with a $\frac{3}{8}$ inch gap between the two prongs. The retaining clips 21 used to retain the ball marker M have a length of approximately $\frac{3}{4}$ inches. Slot 17 has a width of $\frac{1}{8}$ inch and a length into the body 11 of about $\frac{1}{2}$ inch. It is important that the length of the slot 17 be sufficient to permit the disk D of the ball marker M to be fully contained within the retaining clips 21 while the stem S is within the slot 17. The belt clip 30 can have a length of approximately $1\frac{1}{4}$ inches.

Figure 6:
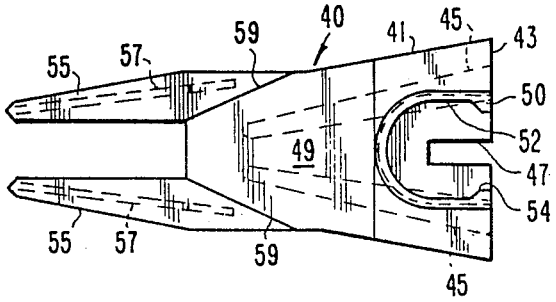
FIG. 6 is a top elevational view of an alternative embodiment of the present invention.
Figure 7:
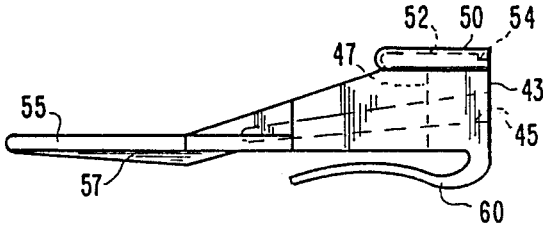
FIG. 7 is a side elevational view of the alternative embodiment shown in FIG. 6.

FIGS. 6 and 7 offer an alternative embodiment of the invention in which a golf device 40 includes a body 41 having an end face 43. A pair of cavities 45 extend inwardly into the body 41 from the end face 43 to accommodate a pair of golf tees as previously described. The golf device 40 also includes a slot 47 which is similar to the slot 17 of the prior embodiment. In a variation from the first embodiment of the golf device 40 includes a retaining collar 50 formed on the top face 49 of the body 41. The retaining collar 50 is partially circular in shape with an opening aligned with the slot to permit passage of the marker disk D therethrough. The collar is dimensioned to surround at least the perimeter of a typical ball marker M. The retaining collar 50 includes a lip 52 which has an inner diameter slightly smaller than the diameter of the disk D of the ball marker and is offset from the top face 49 by at least the thickness of the marker disk. Sufficient space must be provided radially inboard of the lip 52 to permit finger or thumb access to the disk D to remove the marker M from the device 40. The lip 52 is formed into a pair of tabs 54 adjacent the end face 43 of the body. The tabs 54 project slightly inward, as shown in FIG. 6, as well as slightly downward, as shown in FIG. 7. The distance between the opposite tabs 54 is slightly less than the diameter of the marker disk D. The retaining collar is integrally formed with the body 41 of the same resilient material so that the tabs 54 will deform slightly to permit the disk D of the ball marker to be pushed or pressed into the retaining collar 50. Once the ball marker is within the generally circular retaining collar 50 with the stem S extending into the slot 47, the tabs 54 tend to hold the marker in place.

In another variation from the prior embodiment, the golf device 40 includes a pair of turf repair tool prongs 55, each having a beveled rib 57 extending along the length of the prong. In addition, the golf device 40 includes a cut back portion 59 at one end of the prongs. This cut back portion increases the surface area of the turf repair prongs 55.

In still another variation, the golf device 40 of this second embodiment includes an integrally formed belt clip 60. The clip 60 is formed in the same molding process as the other features of the golf device 40, including the cavities 45, the slot 47 and the retaining collar 50. Each of these features of the device 40 can be integrally formed in a typical plastic molding process.

Figure 8:
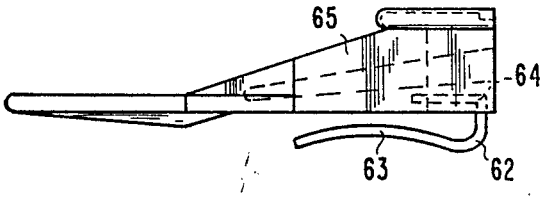
FIG. 8 is a side elevational view of another alternative embodiment of the present invention.

In another alternative embodiment, shown in FIG. 8, a separate belt clip 62 is formed in a U-shape to include a resilient hook portion 63 and a retaining portion 64. The retaining portion 64 is molded into or embedded or fixed in the body 65 of the golf device. Alternatively, the retaining portion 64 may be inserted or snapped into a slot formed end face of the body.

Figure 9:
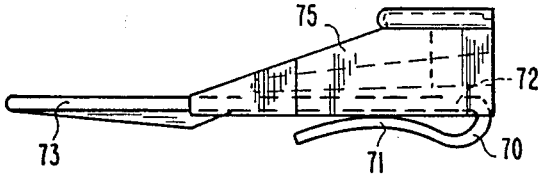
FIG. 9 is a side elevational view of yet another alternative embodiment of the present invention.

In still another alternative, shown in FIG. 9, another separate U-shaped clip 70 includes a resilient hook portion 71, a retaining portion 72 and a pair of turf repair prongs 73. The retaining portion 72 is embedded or fixed within the body 75 when the golf device is molded. The respective clips 62 and 70 of these alternative designs may be composed of metal or plastic, or some other material that is resilient and capable of being molded in situ within a plastic molded body. It is important, however, that the prongs 73 be sufficiently rigid to fulfill their intended function as a turf repair tool without excessive bending. This can be accomplished by forming the clip 70 such that the thickness of at least the prongs 73 is greater than the thickness of the hook portion 71, which latter portion must be resiliently flexible.

Figure 10:
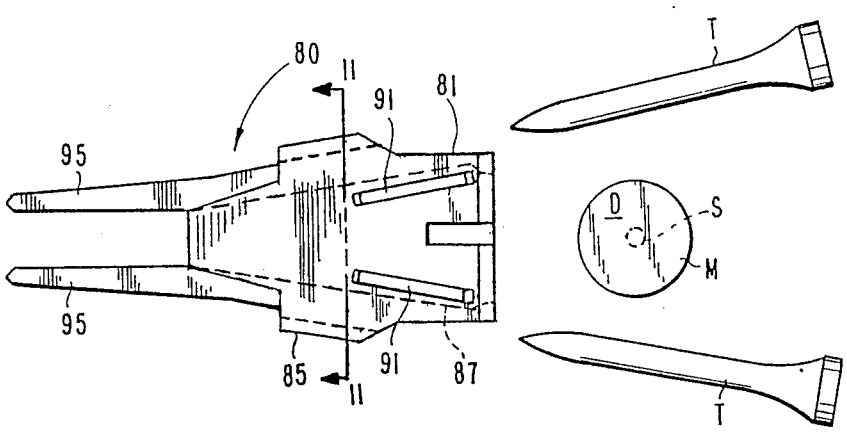
FIG. 10 is a top elevational view of another embodiment of the present invention.
Figure 11:
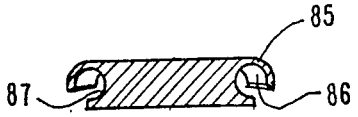
FIG. 11 is a cross-sectional view of the device shown in FIG. 10 taken along line 11—11 as viewed in the direction of the arrows.

In a further embodiment of the invention, illustrated in FIGS. 10 and 11, a device 80 incorporates an alternative structure for supporting the golf tees T. The device 80 includes a body 81 that is similar in construction to the body 10 shown in FIG. 1. A pair of resilient clips 91 are provided on the top face of body 81 to retain the ball spot S. A pair of prongs 95 are integral with the body 81 to form the turf repair tool. In a variation from the previous embodiments, a pair of C-shaped clips 85 project from the side walls of the body 81. The C-clips 85 include a channel 86 and the body 81 includes a co-extensive channel 87 in the side walls that are adapted to accept a golf tee T therein. The C-clips 85 need not be resilient since the golf tees simply slide along the channel 87 into the channel 86 of the clips 85.

While the invention has been illustrated and described in detail in the drawings and foregoing description, the same is to be considered as illustrative and not restrictive in character, it being understood that only the preferrred embodiments have been shown and described and that all changes and modifications that come within the spirit of the invention are desired to be protected.

What is claimed is:

1. A golf device comprising:

a one-piece body having a top face, a bottom face and an end face;

a turf repair tool including a pair of prongs extending from said body opposite said end face;

said body defining a number of elongated cavities extending from said end face into said one-piece body, each of said number of cavities being sized to snugly receive a golf tee therein;

said body further defining a slot having an opening at said top face and at said end face for slidably receiving the stem of a ball marker therein;

retaining means for retaining the disk of the ball marker at said top face when the stem is within said slot, said retaining means being resiliently displaceable to permit insertion and removal of the ball marker disk from the golf device; and a belt clip disposed on said one-piece body at said bottom face.

2. The golf device of claim 1, wherein said retaining means includes:

at least one resilient arm affixed at one end to said top face and having a tip at an opposite free end disposed relative to said slot to retain the disk of the marker under said at least one arm when the stem of the marker is in said slot, said tip further being disposed sufficiently close to said top face whereby the disk of the marker must contact the tip to resiliently displace the tip from the top face to permit insertion or removal of the marker from said retaining means.

3. The golf device of claim 2, wherein said retaining means includes a pair of said resilient arms affixed at opposite sides of said slot, the tips of each of said pair of arms being separated by a distance less than the diameter of the ball marker disk but great enough to permit finger access therebetween for removal of the marker disk.

4. The golf device of claim 1, wherein said retaining means includes:

a partially circular collar formed at said top surface around said slot, said collar including;

a lip having a diameter sized to overlap the perimeter of the disk of the marker when the stem of the marker is within said slot, said lip being disposed from said top face at a height at least equal to the thickness of the ball marker disk; and said collar defining an opening at said end face for passage of the marker disk therethrough; and a pair of tabs at opposite sides of said opening, the distance between the tabs being less than the diameter of the marker disk, said tabs being resiliently deformable to permit insertion into or removal from said collar of the marker disk by deforming said tabs.

5. The golf device of claim 1, wherein said belt clip is integrally formed with said one-piece body.

6. The golf device of claim 1, further including means for engaging said belt clip to said one-piece body at said bottom face in snap-fit engagement.

7. The golf device of claim 1, wherein said belt clip includes:

a resilient hook portion; and a retaining portion, wherein said retaining portion is fixed within said body.

8. The golf device of claim 1, wherein:

said belt clip is generally U-shaped in which one leg of the U-shape is a resilient hook portion and the other leg includes a retaining portion and said pair of prongs of the turf repair tool, said retaining portion being fixed within said body.

9. A golf device comprising:

a one-piece body having a top face, a bottom face, a pair of opposite side faces and an end face;

a turf repair tool including a pair of prongs extending from said body opposite said end face;

said body defining a number of elongated channels in said side faces extending from said end face, each of said number of channels being sized to snugly receive a golf tee therein;

said body further defining a slot having an opening at said top face and at said end face for slidably receiving the stem of a ball marker therein;

retaining means for retaining the disk of the ball marker at said top face when the stem is within said slot, said retaining means being resiliently displaceable to permit insertion and removal of the ball marker disk from the golf device; and a belt clip disposed on said one-piece body at said bottom face.

10. The golf device of claim 9, wherein said body includes a generally C-shaped clip integral with said body at each of said side walls, said clip including a channel therethrough co-extensive with one of said number of channels.

* * * * *